United States Patent [19]

Segrest

[11] 4,241,898

[45] Dec. 30, 1980

[54] PURGE VALVE FOR DIVER'S MASK

[75] Inventor: Steven F. Segrest, Panama City, Fla.

[73] Assignee: The United States of America as represented by the Secretary of the Navy, Washington, D.C.

[21] Appl. No.: 1,505

[22] Filed: Jan. 8, 1979

[51] Int. Cl.[3] ..... F16K 15/18

[52] U.S. Cl. ..... 251/321; 137/543.15

[58] Field of Search ..... 251/321, 322, 323; 137/543.15

[56] References Cited

U.S. PATENT DOCUMENTS

| | | | |
|---|---|---|---|
| 1,045,534 | 11/1912 | Elwell | 137/543.15 X |
| 1,082,508 | 12/1913 | Elwell | 137/543.15 X |
| 1,871,969 | 8/1932 | Elsey | 137/543.15 |
| 2,197,606 | 4/1940 | Birch | 137/543.15 X |

FOREIGN PATENT DOCUMENTS

| | | | |
|---|---|---|---|
| 695491 | 7/1940 | Fed. Rep. of Germany | 251/323 |

*Primary Examiner*—William R. Cline

*Attorney, Agent, or Firm*—Richard S. Sciascia; Harvey A. David

[57] ABSTRACT

A purge valve for full face masks or helmets includes a base member fixed in the mask wall and having passages opening in a flat, annular valve seat surface. A manually operable valve member includes an outer cylindrical wall, an inner cylindrical wall reentrant from an end wall and is axially slidable on a stem extending from the base member against the action of a compression spring nested between the cylindrical walls.

3 Claims, 4 Drawing Figures

PURGE VALVE FOR DIVER'S MASK

BACKGROUND OF THE INVENTION

This invention relates to underwater diving equipment and more particularly to an improved purge valve for use in removing accumulated water from a diver's mask or helmet.

In the use of most diving masks, whether of the partial or full face variety, and of diving helmets, water collects therein in varying amounts due to leakage or to condensation. Masks and helmets have, therefore, often been provided with a purge valve through which such accumulations of water can be periodically discharged from the mask or helmet. The use of such valves is generally in addition to a breathing gas exhaust valve, although in some apparatus the exhaust valve provides a purging function as well.

Prior art purge valves have taken a variety of forms including those having rigid valve members intended to be operated by a pressure differential, yet having a manually operable push buttons or pull knobs, and those having pressure operated rubber flapper valves. The manually operable, spring biased valves have characteristically been difficult to manage with heavily gloved hands and have been subject to entrapment of sand and silt making them difficult to clean, likely to bind or jam, and prone to leakage. The rubber flapper valves are generally subject to leaks and deterioration, are usually incapable of manual operation, and not readily adjustable as to forces necessary to effect opening. The latter renders them generally unsuitable for use in closed or semi-closed breathing circuit diving systems. An example of a known manually or pressure operable purge valve is found at 51 in U.S. Pat. No. 3,968,795, while examples of known flapper type purge valves are shown in U.S. Pat. No. 3,186,005 and U.S. Pat. No. 2,362,240. These known purge valves are representative of valves having the aforementioned disadvantages and shortcomings which are sought to be overcome by the present invention.

SUMMARY OF THE INVENTION

With the foregoing in mind, it is a principal object of this invention to provide an improved purge valve for use with diving masks or helmets.

Another object of the invention is to provide an improved manually operable purge valve that is exceptionally reliable in operation and not prone to binding, jamming or leaking even when used in sand or silt laden waters.

As another object, the invention aims to provide a valve device of the foregoing character that can readily be rinsed clean with a low pressure water hose, without need for any disassembly.

Still another object is the provision of a diver's purge valve that is simple and inexpensive in construction, and requires no close tolerances or precision fitting of parts.

Yet another object is to provide a valve device, for use with diving masks or helmets, that can be easily disassembled for adjustment and repair, if any such is ever needed, without removal of the valve body from the associated helmet or mask.

A further and important object is the provision of a purge valve that is suitable for use in full face masks and diving helmets forming part of a closed or semi-closed breathing system wherein it is important that the purge valve be insensitive to slight overpressures in the mask or helmet relative to ambient pressures.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
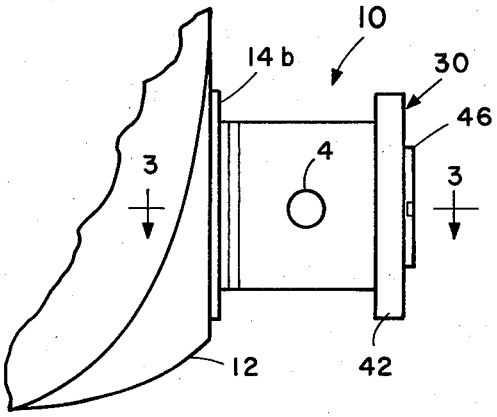
FIG. 1 is a side elevational view of a purge valve embodying this invention and shown in association with a portion of a diving mask.
Figure 2:
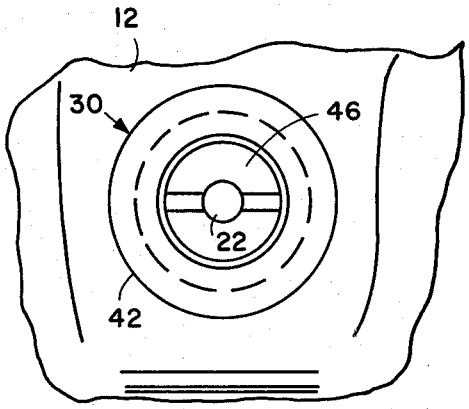
FIG. 2 is an end view of the valve of FIG. 1.

In the form of the invention illustrated in the drawings and described hereinafter, a manually operable purge valve, indicated generally at 10, is mounted in the lower regions of a diver's full face mask 12. The valve 10 is used by the diver to drain or expel from the mask accumulations of water which may occur due to leakage, condensation, or the like.

Figure 3:
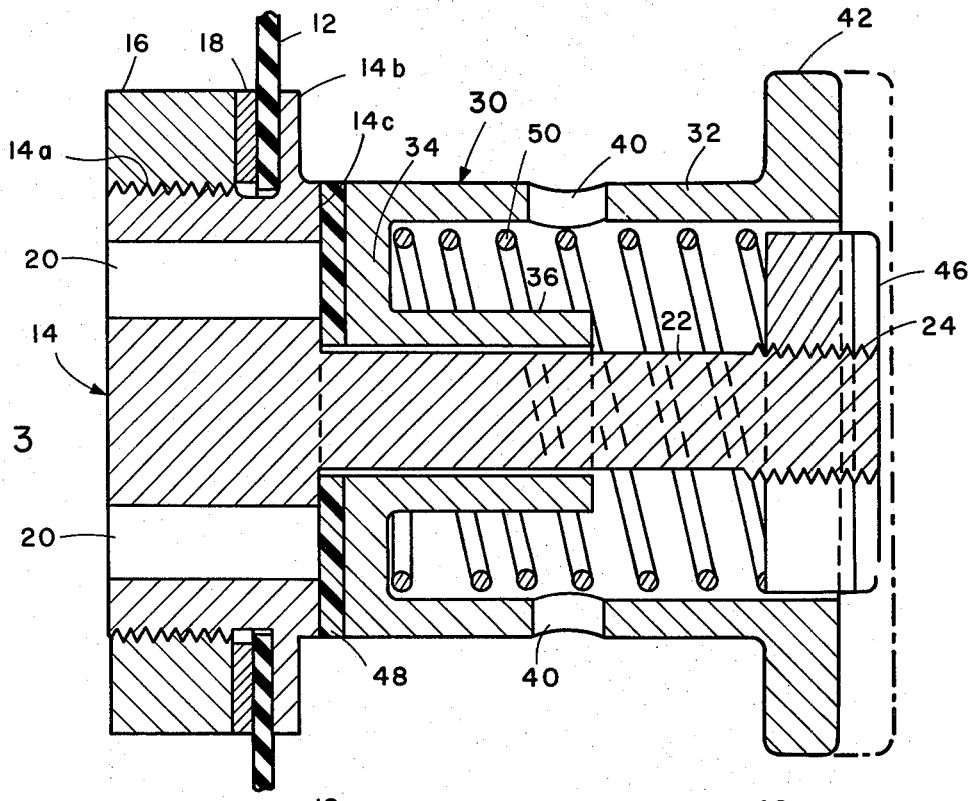
FIG. 3 is an enlarged sectional view of the valve of FIG. 1 taken substantially along line 3—3 of FIG. 1.

Referring now to FIG. 3, the purge valve 10 comprises a circular base member 14 having an externally threaded inner end portion **14*a* extending through an opening in the wall of the face mask 12. A nut 16 on the threaded portion 14*a* and a washer 18 clamp the wall of the mask 12 against a radial flange portion 14*b*** of the base member, thereby securing the base member to the mask or helmet wall in watertight relation thereto.

A plurality of passages 20 extend through the base member 14 and open through a flat, annular valve seat surface **14*c* surrounding an axially extending rod-like stem 22. The stem 22, the axis of which is normal to the plane of the valve seat surface 14*c*, may be formed integrally with the base, as shown, or may comprise a separate element threaded into the base. The outer end portion of the stem 22 is threaded as shown at 24**.

A manually operable valve member, indicated generally at 30, is slidably mounted on the stem 22. This valve member comprises an outer cylindrical wall 32, an annular end wall 34 normal to the axis of wall 32 and juxtaposed to the valve seat surface **14*c*, and an inner cylindrical wall 36 that is reentrant from the end wall 34 and coaxial with the outer cylindrical wall. The inner cylindrical wall 36 is conveniently shorter than the outer wall 32. The latter is provided with diametrically opposed openings 40 and with a flange 42 extending radially from the end opposite or remote from the end wall 34**.

A retaining nut 46 is threadedly engaged on the outer end of the stem 22 and limits movement of the valve member 30 along the stem in a direction away from the valve seat surface **14*c*. The nut 46 is at least partially recessed within the valve member 30** when the valve is closed.

An annular washer or gasket 48, formed of neoprene rubber or other resilient material, is fixed by suitable cement to the end wall 34 of the valve member 30 and is adapted to close or obturate the passages 20 when the valve member is in the position illustrated in FIG. 3.

A compression spring 50 is nested between the inner and outer cylindrical walls 32, 36 and acts between the end wall 34 and the retainer nut 46 to yieldably urge the valve member 30 toward the base member 14.

Figure 4:
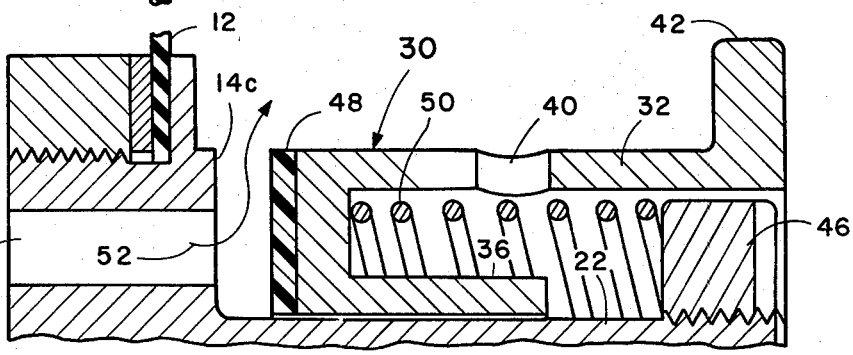
FIG. 4 is a fragmentary view similar to FIG. 3 but showing parts in different operative positions.

In operation, when the diver desires to purge water from his mask or helmet, he assumes a position such that water collects over the valve 10, then he manually pulls the valve member 30 away from the base member 14 against the action of the spring 50. This moves the gasket 48 of the valve member away from the seat surface 14c as shown in FIG. 4, and water is drained or expelled through the passages 20 to the ambient water as shown by the flow arrow 52. When the diver releases the valve member 30, it and its gasket 48 are returned by the spring to their FIG. 3 positions, again sealing the ends of the passages 20.

The shape of the valve member 30, with its flange 42, permits easy operation even with heavy gloves or mittens. The valve 10 is readily assembled and disassembled if necessary for inspection or repair, by simple removal of the nut 46 and without disturbing the valve base member 14.

There are no fully closed cavities to trap dirt or require pressure balancing and the device is not affected by extreme operating depths. Moreover, ample clearances can be used between the valve member 30 and the stem 22, without deleterious effect, so that cleaning can readily be accomplished by hose.

It will be noted that because the valve seat surface is plane, when the valve is closed the effective area on which pressures can act tending to open the valve is limited to the actual areas of the passage openings. The valve 10 is thereby rendered less sensitive to overpressures in the mask or helmet and so is not likely to usurp the function of the mask or helmet exhaust valve arrangement.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A purge valve for use in combination with a diving mask or helmet having a wall, said purge valve comprising:

a generally cylindrical base member having an inner end portion adapted to be fixed in an opening in said wall and an outer end portion extending outwardly of said wall and presenting a plane, annular valve seat surface, said base member having a plurality of passages extending axially therethrough and opening in said valve seat surface;

a stem of predetermined length having its long axis normal to said valve seat surface and extending outwardly from said base member;

a valve member slidably mounted on said stem and having a cylindrical outer wall having an outside diameter substantially equal to the diameter of said valve seat surface and an axial length substantially equal to said predetermined length, an annular end wall normal to the central axis of said cylindrical outer wall, and a cylindrical inner wall reentrant from said end wall and in coaxial spaced relation within said cylindrical outer wall, said cylindrical inner wall being shorter than said cylindrical outer wall and surrounding said stem with said annular end wall in juxtaposition with said valve seat surface;

retainer means mounted on the outer end of said stem, said retainer means being engageable by the outer end of said cylindrical inner wall to limit movement of said valve member away from said valve seat surface;

a compression spring nested within said valve member between said inner and outer cylindrical walls and acting between said retainer means and said annular end wall to yieldably urge said valve member along said stem toward said base member, whereby said passages are normally obturated by engagement of said end wall with said valve seat, and are opened by retraction of said valve member away from said base member;

said valve member being open at the end of said cylindrical outer wall remote from said annular end wall and comprising a flange extending radially outwardly from the open end of said cylindrical outer wall for manual retraction of said valve member by a diver; and said retainer means being at least partially recessed into and in radially spaced relation with said open end of said cylindrical outer wall of said valve member and being removable from said stem to permit ready disassembly of said valve member and spring from said base member and stem.

2. A purge valve as defined in claim 1, and further comprising:

a resilient, plane gasket carried by said annular end wall for sealing engagement substantially throughout said valve surface and in obturating relation to the discharge end of each of said passages.

3. A purge valve as defined in claim 1, and wherein:

said valve member comprises diametrically located openings in said cylindrical outer wall whereby said valve member is freely floodable and can be flushed with low pressure water directed into said open end of said cylindrical outer wall.

* * * * *